United States Patent [19]

McIntyre

[11] Patent Number: 4,726,887

[45] Date of Patent: Feb. 23, 1988

[54] PROCESS FOR PREPARING OLEFIN OXIDES IN AN ELECTROCHEMICAL CELL

[75] Inventor: John M. McIntyre, Lake Jackson, Tex.

[73] Assignee: The Dow Chemical Company, Midland, Mich.

[21] Appl. No.: 813,449

[22] Filed: Dec. 26, 1985

[51] Int. Cl.[4] ..... C25G 3/02
[52] U.S. Cl. ..... 204/80
[58] Field of Search ..... 204/80, 128, 98

[56] References Cited

U.S. PATENT DOCUMENTS

| | | | |
|---|---|---|---|
| 3,147,203 | 9/1964 | Klass | 204/80 |
| 3,451,905 | 6/1969 | Kronig et al. | 204/80 |
| 3,497,431 | 2/1970 | Kronig et al. | 204/80 |
| 4,191,618 | 3/1980 | Coker et al. | 204/128 |
| 4,221,644 | 9/1980 | LaBarre | 204/128 |

*Primary Examiner*—R. L. Andrews

[57] ABSTRACT

A method of converting olefins, preferably butylene or propylene into oxides is disclosed. A metal halide salt, preferably KBr, is introduced into an electrochemical cell wherein the cathode has a gas side preferably supplied with oxygen and operated at a low voltage to suppress hydrogen production.

10 Claims, 1 Drawing Figure

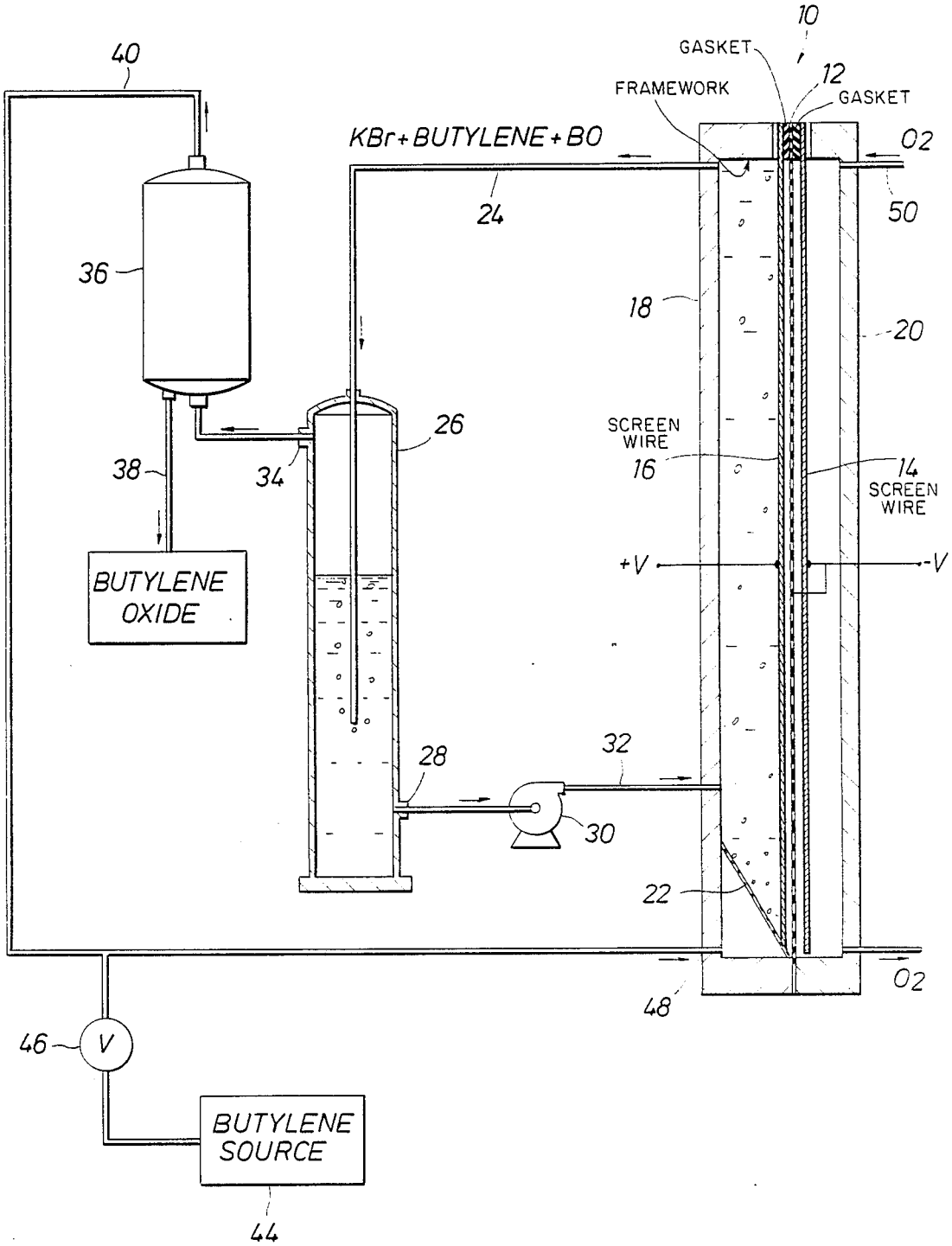
10
GASKET
12
GASKET
FRAMEWORK
40
KBr+BUTYLENE+BO
O2
24
50
36
18
20
26
SCREEN WIRE
16
14
SCREEN WIRE
38
34
+V
-V
BUTYLENE OXIDE
28
32
30
22
O2
48
46
V
BUTYLENE SOURCE
44

PROCESS FOR PREPARING OLEFIN OXIDES IN AN ELECTROCHEMICAL CELL

BACKGROUND OF THE DISCLOSURE

This disclosure is directed to a method of forming oxides of olefins, and particularly butylene and propylene oxides. The method of manufacture utilizes an electrolysis cell featuring a depolarized cathode for olefin oxide production.

This electrolytic process prepares butylene oxide or propylene oxide (BO or PO hereinafter). Electrolysis conversion of olefins to oxides is ordinarily handicapped by the production of hydrogen gas through HOH disassociation. Rather than use NaCl, the present process preferably uses KBr. An alternative salt is KCl. The process typically liberates elemental hydrogen. Because it is such a light weight molecule and diffuses readily, it is difficult to separate from the product and unreacted olefin. The hydrogen diffuses into the olefin oxide product and unreacted olefin removed from the electrolysis cell. After olefin oxide recovery, this then requires hydrogen separation so that the unreacted olefin can be recycled back to the cell. It is difficult to separate hydrogen and unreacted olefin to enable recycling of the olefin.

It has been discovered that the cathode is best a gas cathode. A continuous feed of oxygen to the cathode is highly desirable while a mixture of oxygen and nitrogen is also permissible. Cell voltage appears to be favorably reduced with pure oxygen in contrast with a nitrogen mix. As will be described, a mixture of the two can also be used to partially or significantly reduce electrode voltage. The gas supply to the cathode modifies the cathodic reaction. Ordinarily, the water solution adjacent the cathode decomposes into hydrogen and hydroxide ions. This leads to the production of hydrogen gas. However, furnishing oxygen in sufficient supply to the cathode enables the oxygen to react with the water, yielding only OH ions. No hydrogen gas is liberated.

The reactions occurring in the vicinity of the anode involves olefin conversion to form BO or PO. To the extent unreacted olefin is present, it can be readily separated from the olefin oxide produced without the added difficulty of separation from hydrogen. This enables the electrolyte, a metal halide (preferably an alkaline metal such as potassium) to be recycled repetitively. The electrolyte is then recycled to dissolve additional olefin to be processed, making the desired BO or PO. The absence of hydrogen from the electrolyte thus avoids difficult and expensive downstream separation process steps which could otherwise make the process unacceptable in commercial applications.

In summary, the process of this disclosure forms BO or PO and may be described as an olefin oxidation process which enables recycling of the supplied olefin until it is converted. This recycling enables the provision of economical and highly efficient process. This enables production of BO or PO in commercial quantities.

BRIEF DESCRIPTION OF THE DRAWINGS

So that the manner in which the above recited features. advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

This enclosed drawing is a flow diagram of an electrolysis cell constructed and arranged to manufacture olefin oxides in accordance with the teachings of the present disclosure.

DETAILED DESCRIPTION OF THE PREFERRED EMBODIMENT

Attention is first directed to the single drawing showing the apparatus to be described. Thereafter, the method of operation will be set forth in detail. The numeral 10 identifies an electrolysis cell. It has a gas depolarized cathode 12 with a cathode current collector 14 on one side and an anode 16 on the opposite side. The cell is enclosed within an anode housing 18 and a mating cathode housing 20. A screen 22 is included at the lower portions of the anode chamber. The screen is used to break up olefin feed and form multitudinous small bubbles as the feed rises by gravity in the electrolyte. More will be noted regarding the feed.

At the top of the cell, an anolyte line 24 removes a flow of liquid having gasses therein. This liquid with gasses is delivered to a separator column 26. In the column 26, the liquid is permitted to settle to the bottom and is removed through an outlet 28, delivered to a pump 30 an recycled through a supply line 32. The separator column has an overhead chamber which collects gas liberated from the separated liquid. The hot gas is removed through a gas outlet 34. It is then delivered to a cooled condenser 36. One outlet from the gas separator is a line 38 which delivers the condensed BO. Another outlet line 40 for removel of the uncondensed gas recycles the unreacted olefin. The line 40 is thus returned to the cell 10 below the screen 22. Since a certain portion of the olefin is consumed, there is a makeup source to add olefin. The source 44 delivers additional olefin which is supplied through a regulator valve 46. The recycled and unreacted olefin is thus added to the makeup olefin, this being delivered to the cell 10 through the inlet 48.

On the cathode side, electrolyte wets one side of the cathode. In addition, there is an inlet 50 provided for oxygen. The oxygen is delivered to the cathode at the back side, thereby defining a gas cathode. More will be noted concerning this hereinafter.

The electrolyte is formed of a water solution of a alkali metal halide. The preferred alkali metal is potassium although sodium can be used. Due to cost, other alkali metals are less desirable than potassium. The preferred salt is KBr. Less desirable salts are various chlorides. In general terms, the other halides are far less desirable and generally do not provide an efficient system. For instance, fluorides are excessively active, which does not benefit the process, while iodides are sufficiently low in activity, thus the process is less inefficient. It is particularly desirable that the alkalimetal halide go into solution readily to obtain the necessary processing in the cell 10. Accordingly, the preferred salt is KBr in water solution at some level below saturation. The olefin which is delivered from the source 44 is preferably butylene olefin. An alternative is propylene. Other olefins can be processed into various olefin oxides, but the preferred olefins are either butylene or propylene. The flow is delivered into the cell through the port 48. The olefins are permitted to defuse through the electrolyte chamber. They pass through the openings in the screen 22 which breaks the feed into very small bubbles to obtain significant olefin diffusion.

The ionized bromide in the vicinity of the anode 16 is converted into soluble bromine. Bromine in water reacts to form hypobromite. The hypobromite is available to react with the olefin to produce an intermediate product, namely a bromohydrin. The bromohydrin in turn is reacted with the hydroxide to yield to olefin oxide such as BO, or PO if the feed is propylene while the bromine goes into ionic solution.

Via the outlet line 24, the water solution removes the metal alkali halide salt (recall that potassium and bromine are the preferred salt constituents) along with olefin and the olefin oxide. The water solution is then delivered to the separator 26 where the gasses are separated for removal. The separator 26 thus furnishes a water solution of the KBr for recycling. In theory, practically all the salt is recycled repetitively and very little is lost. A makeup charge of potassium bromide is seldom required. Water may be added to replace that lost by evaporation.

The gas separator 36 separates out the unreacted olefin and returns it to the electrolysis cell 10. Since a significant portion of the olefin is converted to product, that portion is removed through the line 38. It is delivered to a storage facility where the BO or PO is thus stored after separation. The butylene source 44 provides a flow of makeup gas. The makeup is furnished to continue the operation of electrolysis cell 10 with a substantial flow of olefin to assure conversion.

Perhaps an example will best set forth operation of the apparatus. In a laboratory scale, the electrolysis cell 10 was constructed from glass and provided with a one inch diameter platinum screen to be used as the anode 16. A suitable cathode was obtained, formed of porous carbon coated with a silver catalyst and bonded together with poly tetrafluroethylene. A flow of oxygen was introduced on the backside of the cathode. A 1% solution of KBr was mixed with propylene and recycles to assure that the anolyte was substantially saturated with the olefin. The cell was operated at approximately 45° C. The pH of the electrolyte was about 11.2. Suitable electrical power was provided from a DC source at various current levels. An acceptable current level was selected to be 20 ma/cm$^2$. The cathode voltage was −0.239 volts when compared with a saturated calomel reference electrode on the gas side in the presence of oxygen. With only nitrogen on the cathode, the voltage measured −1.493 against the reference. As will be observed, a voltage saving of about 1.254 volts can be obtained by switching from nitrogen to oxygen. After operation of the cell for a period of about one hour, the discharged electrolyte contained approximately 0.4 grams of PO, measured by conventional chromatographic methods. When the cathode was operated at reduced voltage in the presence of oxygen, no hydrogen was evolved. However, the voltage became sufficiently negative in the presence of nitrogen that hydrogen was liberated in operation. A positive oxygen pressure is normally applied to the cathode to assure that gas is forced into the cathode preventing the solution flooding of the cathode.

The silver on the cathode adds a catalyst function to assist efficient oxygen conversion. The foregoing process is successful in forming BO or PO. Moreover, the process operates continuously so that a continuous conversion can be obtained. To the degree that unreacted olefin is recovered from the electrolysis cell 10, it is easily recycled. To the extent that any unreacted olefin is recovered at the separator 26, it is recycled and not wasted. Moreover, the process operates with a substantially reduced voltage drop across the electrode system. This requires less power. Even more importantly, the low voltage provided to the cathode in comparison with a standard reference electode defines a system which forms no hydrogen gas.

Variations can be adapted in the present process. Recall that mention was made of using several olefin feeds. The salt used in the system is preferably KBr but other salts can be used. The choice of salt is dependent on obtaining a desired chemical activity for the chosen salt.

While the foregoing is directed to the preferred embodiment, the scope thereof is determined by the claims which follow.

I claim:

1. A method of producing olefin oxides in an electrochemical cell having spaced anode and cathode electrodes connected for providing a current flow through an electrolyte in the cell, the method comprising the steps of:

(a) introducing an aqueous alkali metal chloride or bromide solution electrolyte mixed with an olefin to be oxidized and forming a hydrin from the olefin;

(b) introducing oxygen or an oxygen enriched gas in the vicinity of the cathode in the cell to assist in forming hydroxide ions in solution, said cell being operated at a voltage selected to cause current flow in the cell and sufficiently low in voltage that hydrogen is not liberated in the cell and wherein hydroxide ions react with the hydrin to form an oxidized olefin;

(c) removing cell electrolyte containing oxidized olefin therein; and (d) separating the olefin oxide from the removed electrolyte.

2. The method of claim 1 wherein the anode is positioned in the electrochemical cell in the presence of an electrocatalyst, and wherein oxygen in the vicinity of the cathode is introduced in gaseous form adjacent to the cathode.

3. The method of claim 1 wherein the metal halide salt solution electrolyte mixed with an olefin is introduced near an anode in the cell.

4. The method of claim 1 wherein the alkali metal halide salt is potassium bromide in aqueous solution.

5. The method of claim 1 wherein the olefin is propylene or butylene.

6. The method of claim 1 wherein the anode of the cell is formed of a conductive material which further is associated with a catalyst cooperative with the anode for reacting the halide electrochemically to produce hypohalide in the electrolyte thereby oxidizing the olefin.

7. The method of claim 1 including the step of introducing sufficient oxygen in the vicinity of a cathode placed in the cell to form hydroxide ions in the electrolyte.

8. The method of claim 1 wherein the cathode voltage in comparison with a standard calomel reference electrode is negative but insufficiently negative to intitiate liberation of hydrogen from water in the cell electrolyte.

9. The method of claim 1 wherein the anode has a catalyst therewith to initiate halide conversion.

10. The method of claim 1 including the step of introducing olefin as small bubbles into an electrolysis cell.

* * * * *